United States Patent [19]

Champigny

[11] Patent Number: 4,809,725

[45] Date of Patent: Mar. 7, 1989

[54] TELESCOPIC CRUTCH AND WALKING STICK

[76] Inventor: Patrick Champigny, 4458 Levesque, St Vincent de Paul, Quebec, Canada, H7C 1M6

[21] Appl. No.: 3,865

[22] Filed: Jan. 16, 1987

Related U.S. Application Data

[63] Continuation-in-part of Ser. No. 828,700, Feb. 12, 1986, abandoned.

[51] Int. Cl.[4] ..... A45B 9/00

[52] U.S. Cl. ..... 135/75

[58] Field of Search ..... 135/65–69, 135/71–73, 75–76, DIG. 9; 403/108, 109, 322, 327, 328; 248/155, 188.5, 326, 333; 24/457, 618, 626; 229/DIG. 10; 411/348, 351, 517, 518, 519, 521

[56] References Cited

U.S. PATENT DOCUMENTS

| | | | |
|---|---|---|---|
| 814,035 | 3/1906 | Garrett | 135/76 |
| 2,516,852 | 8/1950 | Burry et al. | 135/72 |
| 2,590,607 | 3/1952 | Grimball | 135/69 |
| 2,817,348 | 12/1957 | Holliday, Jr. | 135/69 |
| 2,960,095 | 11/1960 | Smith, Jr. | 135/65 |
| 3,016,060 | 1/1962 | Beattie, Jr. | 135/73 |
| 4,385,849 | 5/1983 | Crain | 403/109 |

FOREIGN PATENT DOCUMENTS

| | | | |
|---|---|---|---|
| 122694 | 1/1919 | United Kingdom | 135/69 |
| 2136290 | 9/1984 | United Kingdom | 135/66 |

*Primary Examiner*—Robert A. Hafer
*Assistant Examiner*—Charles H. Sam
*Attorney, Agent, or Firm*—Robic, Robic & Associates

[57] ABSTRACT

A telescopic combined crutch and walking stick, having a lower ground-engaging tube; a middle tube mounted slidably and non-rotatably in the ground engaging tube and lockingly therein for positioning it in the lower tube in one of several selectable positions; and an upper tube mounted slidably and non-rotatably in middle tube and lockingly therein for positioning it in the middle tube in one of several selectable positions. The tubes are of a length such that, when they are fully retracted one into the other, the length of the combined crutch and stick is about ⅓ the length when fully extended. The combination further includes an armpit support mounted at the upper end of the upper tube, and a walking stick handle mounted at the upper end of the middle tube.

16 Claims, 5 Drawing Sheets

TELESCOPIC CRUTCH AND WALKING STICK

CROSS-REFERENCE

The application is a continuation-in-part of U.S. patent application Ser. No. 828,700 filed on Feb. 12, 1986, now abandoned.

BACKGROUND OF THE INVENTION (a) Field of the Invention

The present invention relates to a telescopic combined crutch and walking stick.

(b) Brief Description of the Prior Art

Crutches or walking sticks made of metal tubings and comprising one or more telescopic portions to make them adjustable as to length to suit persons of different heights, are well known in the art and commonly available almost everywhere. By way of examples, reference can be made to British Patent No. 685,781 to CONCENTRIC MANUFACTURING COMPANY LTD. and U.S. Pat. Nos. 2,383,786 to GISH; 2,575,681 to PETERS; 2,590,607 to GRIMBALL; 2,630,128 to SLATER and 2,817,348 to HOLLIDAY, Jr.

Crutches made of a sufficient number of telescopic tubings to make them easily collapsible and compressible to such an extent that they can, when not in use, be conveniently put away and packed into a suitcase and, when required for use, be very easily extended in operative position, are also known. By way of example, British Patent No. 122,694 to Kelly discloses such a crutch made of several lengths of tubing telescoping into each other so that they can be extended or contracted.

In addition, devices which can be used as a conventional walking stick and may be easily converted into a crutch, are further known. Thus, by way of example, U.S. Pat. No. 2,960,095 to SMITH, Jr. discloses a combined crutch and walking stick "wherein the structural elements forming the crutch may be collapsed so as to be virtually unnoticeable when the device is used as a cane". This article which is made of metal tubings, is telescopic and thus is not only convertable but also adjustable as to length, both when used as a walking stick and as a crutch.

OBJECTS OF THE INVENTION

A first object of the present invention is to provide a combined crutch and walking stick which may not only be rapidly and easily converted from one use to the other and vice-versa like the article disclosed in U.S. Pat. No. 2,960,095, but which may also be rapidly and sufficiently collapsed to be insertable in a small piece of luggage, such as a brief case, while yet being extensible adjustably to suit the height of any average crutch user.

Another object of the present invention is to provide an article of the above mentioned type, wherein all the telescopically adjustable lengths of tubing are slidably and non-rotatably mounted inside the others, and wherein all but one of a plurality of selectable positions in each adjustable length may be blocked by the user after suitable adjustment to his or her physical requirements. These particular features are of a great interest as they allow the combined crutch and walking stick according to the invention to function appropriately and they avoid undue tube adjustment. When the selectable positions consist of a plurality of aligned holes provided in some tubes, these features may advantageously be achieved by the provision of flattened sections formed on the telescoping tubes, which sections face one another and thereby prevent relative rotation between the tubes and thus any misalignment of the holes of the tubes, and by the provision of blocking means such as resilient rings or strips attachable to the tube walls for blocking all but one of the aligned holes of each tube. Such provisions give some kind of "memory" to the article, which becomes indeed always extendable to its predetermined length without requiring any adjustment.

A further object of the present invention is to provide an article of the above mentioned type, wherein the armpit and the handle are each provided with cushioning sleeves made of flexible material, preferably rubber, which sleeves have an outwardly tapering shape making them particularly suitable for hanging the combined crutch and walking stick to a shelf or from a table with the handle resting on the flat surface of the table.

Still another object of the invention is to provide an article of the above type which is quite simple in construction so that it can be produced at a relatively low cost.

SUMMARY OF THE INVENTION

The telescopic, combined crutch and walking stick according to the invention basically comprises:

a lower ground-engaging tube;

a middle tube slidably mounted in the ground engaging tube;

first locking means in the middle tube for positioning this middle tube in the lower tube in one of several selectable positions;

an upper tube slidably mounted in the middle tube, this upper tube having a free upper end, second locking means in the upper tube for positioning the upper tube in the middle tube in one of several selectable positions;

an armpit support mounted at the upper end of the upper tube; and a walking stick handle mounted at the upper end of the middle tube.

The lower, middle and upper tubes are of a length such that, when they are fully retracted one into the other, the length of the combined crutch and stick is about $\frac{1}{3}$ the length thereof when fully extended.

The middle and lower tube are each formed with aligned holes passing through and spaced along their walls.

The first locking means used for positioning the middle tube in the lower tube comprises a first detent knob transversally extending inside of and at the lower end of the middle tube, and spring means for resiliently pressing this first knob into one of these aligned holes of the lower tube when in registry therewith. Similarly, the second locking means used for positioning the upper tube in the middle tube comprises a second detent knob transversally extending inside of and at the lower end of the upper tube, and spring for means resiliently pressing said second knob into one of the aligned holes of the middle tube when in registry therewith.

In accordance with a first aspect of the invention, the combined crutch and walking stick further comprises means for preventing relative rotation of the lower middle and upper tubes and means for blocking all but one of the aligned holes of both the lower and middle tube.

The rotation preventing means may preferably consist of flattened sections provided in the lower, middle and upper tubes, these flattened sections facing one another. In such a case, the aligned holes of the lower and middle tubes are respectively formed through the flattened sections of these lower and middle tubes.

Provided that the aligned holes of the lower and middle tubes are each formed with a groove along at least part of their walls, the blocking means may comprise resilient rings removably lodged into the grooves of all of the holes but one, for blocking entry of the detent knobs.

Provided that straight slide grooves are formed lengthwise of and inwardly of the middle and lower tubes flattened sections, these slide grooves bordering the aligned holes of these middle and lower tubes, the blocking means may comprise flat strips slid in the grooves, these strips having essentially the same length as the middle and lower tubes, respectively, and being each provided with a single hole positioned so as to register with a preselected hole of the corresponding middle r lower tube thereby to allow the corresponding detent knob to move only into the preselected hole when the tubes are adjusted with respect to each other.

In accordance with another aspect of the invention, the combined crutch and walking stick is so designed that the aligned holes of the middle tube are evenly spaced from one another; the aligned holes of the lower tube are evenly spaced from one another; and the spacing between the aligned holes of either of the middle and lower tubes is greater than the spacing between the aligned holes of the other tube. This particular feature affords a better selection as to total length of the combination.

In accordance with a further aspect of the invention, the armpit support comprises a T-shaped member having a transverse armpit rest; a pair of free ends; a central cavity extending perpendicularly into the armpit rest, the cavity being sized to fit over the upper end of the upper tube; and means such as a screw, for detachably fixing the armpit rest onto the upper end of the upper tube when this upper end is fitted in the cavity. A pair of cushioning sleeves made of flexible material are force-fitted over the T-shaped member from the free ends thereof toward the central cavity. These sleeves which act as cushions each have a cross-section evenly increasing in size from the central cavity to the free ends of the T-shaped member.

A similar cushioning sleeve may also or alternatively be force-fitted over the handle to make it easy to grip in addition of making the walking stick easily hangable to a table.

In order to make the combined crutch and walking stick according to the invention much easier to assemble, the first locking means are preferably mounted in a small well, provided in a first plug made of plastic material and fixed to the lower end of the middle tube. Similarly, the second locking means are preferably mounted in a small well, provided in a second plug made of plastic material and fixed to the lower end of the upper tube, these first and second plugs being each provided with an outwardly projecting skirt for slidably guiding the lower ends of the middle and upper tubes centrally inside the lower and middle tubes, respectively.

BRIEF DESCRIPTION OF THE DRAWINGS

The invention, its structure and its advantages will be more readily apparent from the description that follows of a preferred embodiment thereof, given in connection with the accompanying drawings wherein.

DESCRIPTION OF A PREFERRED EMBODIMENT

Figure 1A:
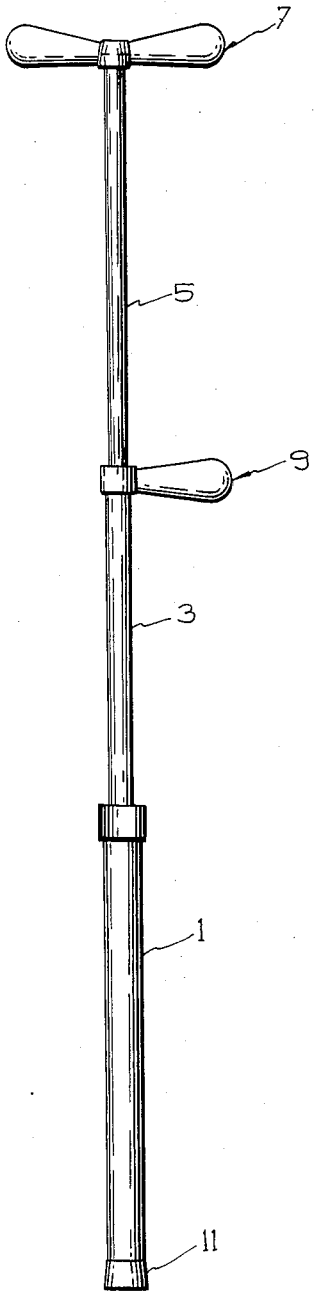
FIGS. 1*a* and 1*b* are side and front elevational views, respectively, of a combined crutch and walking stick made according to the teaching of the invention, shown in fully extended condition.

The telescopic collapsable combined crutch and walking stick or cane according to the invention as shown in the accompanying drawings comprises a lower ground engaging tube 1, a middle tube 3 telescopically slidable inside the lower tube 1 and an upper tube 5 slidably and telescopically received within the middle tube 3 and having, at its upper free end, an armpit support 7. A walking stick handle 9 is provided at the upper end of the middle tube 3. In addition, the lower end of the lower tube 1 has a ground-engaging rubber pad or foot 11 which may be removably mounted on the end of the lower tube 1.

Figure 1B:
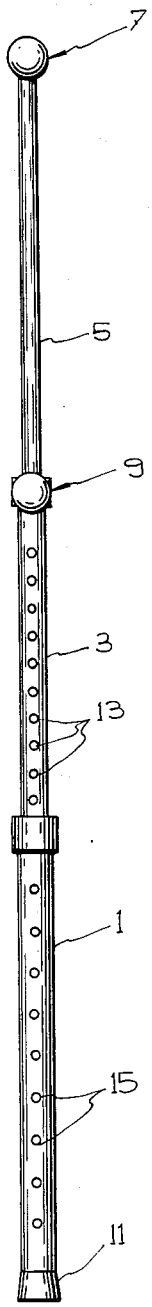
Figure 2:
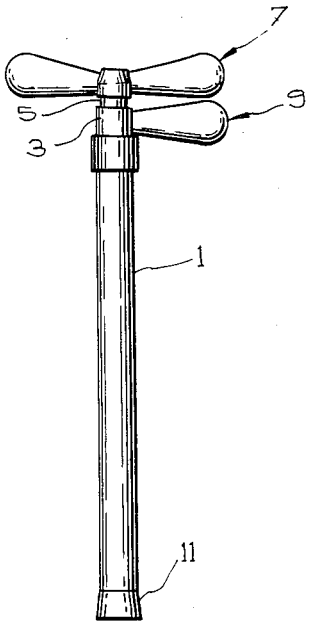
FIG. 2 is a view similar to that of FIG. 1 but with the combined crutch and walking stick in fully collapsed or retracted condition.

It will be noted, particularly from FIGS. 1 and 2, that the tubes 1, 3 and 5 are of a length such that when they are retracted one into the other, as shown in FIG. 2, the overall length of the combined crutch and stick is about $\frac{1}{3}$ the length when fully extended. In other words, tubes 1, 3 and 5 have approximatively the same length.

The middle tube 3 as well as the lower tube 1 are each formed with a series of holes 13, 15, respectively, that extend through and are spaced along the wall of the tubes.

Figure 4:
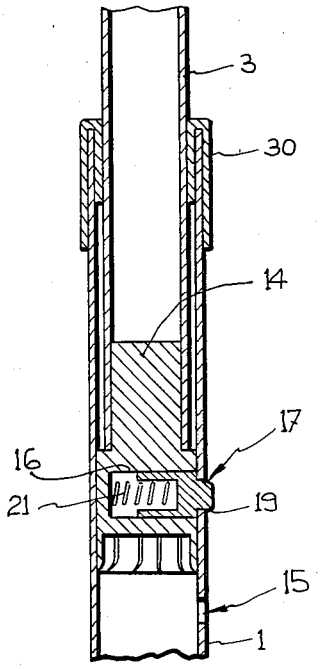
FIG. 4 is an elevational partial cross-section view showing interengagement of two telescoping tubes.

As shown in FIG. 4, first locking means are provided at the bottom end of the middle tube 3 for positioning this tube in the lower tube 1 in one of serial selectable position. These first locking means comprises a first plug 14 made of plastic material, which plug has one end force-fitted into the tube 3 and the other end provided with a transversal well 16 oriented in such a manner as to face the aligned holes 15 of the first tube. A first detent knob 17 is slidably mounted inside the well 16. This knob 17 has a shoulder 19 larger than the hole 15 whereby to prevent it from escaping out of the middle tube 3. A spring 21 resiliently presses the knob 17 into one of the holes 15 and holds it there by engagement of the shoulder 19 with the inner wall of the middle tube 3. As will be noted, the knob 17 has a length which is sufficient for it to enter into any of the holes 15 of the lower tube 1 when one of those holes 15 registers with it. It will thus be appreciated that by pushing the knob 17 inward and out of engagement with one hole 15, it is possible to slide the middle tube 3 with respect to lower tube 1 until a further hole 15 is reached.

There is thus provided means to releasably lock the two tubes 1 and 3 together to arrive at the desired total length. The number of possibilities are of course as great as the number of holes 15 through the tube 1.

Figure 6:
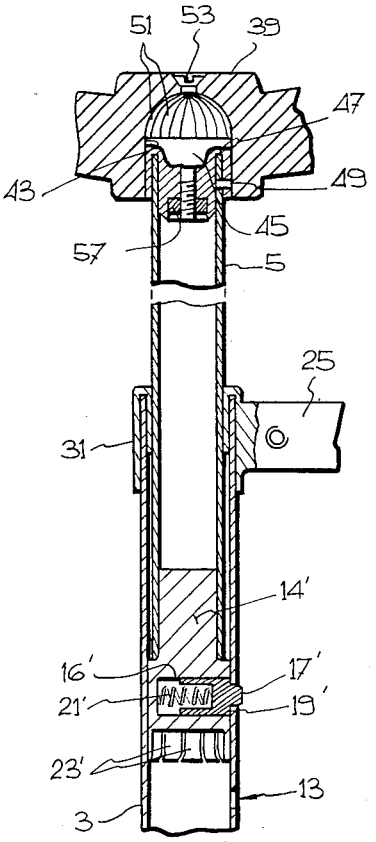
FIG. 6 appearing on the same sheet of drawing as FIG. 3, is a side elevational cross-sectional view of the upper part of the upper tube and the armpit rest attached thereto, and of the upper part of the middle tube and the handle attached thereto.

As shown in FIG. 6, second locking means similar to the first one are provided in a second plug 14' similar to the first one at the lower end of the upper tube 5.

The detent knob 17' of these second locking means are engageable with anyone of the holes 13 provided in the middle tube 3. Consequently, the total length of tubes 3 and 5 can be adjusted as desired, the number of possibilities being likewise equal to the number of holes 13. As these second locking means are identical to the first one, the same structural elements have been identified with the same reference numbers with a distinguishing prime.

The holes of the middle and lower tubes 3 and 1, may be evenly spaced from one another. However, as shown in FIG. 1*b*, in order to afford a better selection as to the length of the combination, the spacing between the holes of one of the tubes is preferably made wider than the spacing between the holes of the other tube.

Figure 8:
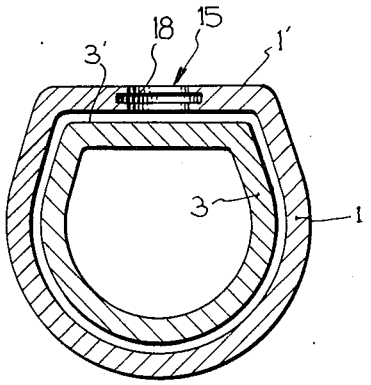
FIG. 8 is a transverse cross-sectional view through the telescoping middle and lower tubes.

In order that the lines of holes 13 and 15 be constantly one over the other, that is normal to the same plane containing the axes of tubes 1 and 3, for easy registration of the holes and insertion thereinto of the detent knobs 17 and 17' of tubes 3 and 5, the three telescoping tubes 1, 3 and 5 must not rotate one with respect to the others. A rotation-preventing means that can be used in accordance with the invention is best illustrated in FIG. 8 showing the telescoping tubes 1 and 3 but in transverse cross-section rather than the longitudinal cross-section of FIG. 3. It will be seen that the tubes 1 and 3 are provided with flattened sections 1' and 3' facing one another thereby preventing relative rotation. The upper tube 5 is likewise provided with a flattened section, not shown. Holes 13 and 15 extend centrally of and through the flattened sections 1' and 3'.

Figure 7:
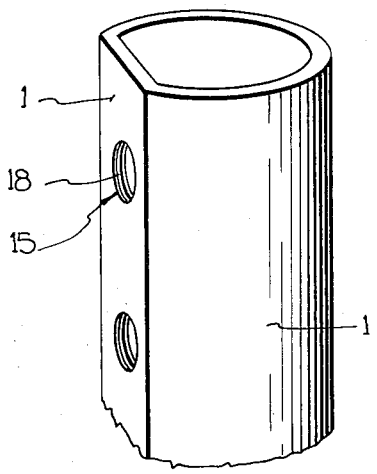
FIG. 7 is a side elevation view of a portion of the lower tube intended to show its flattened section.
Figure 10:
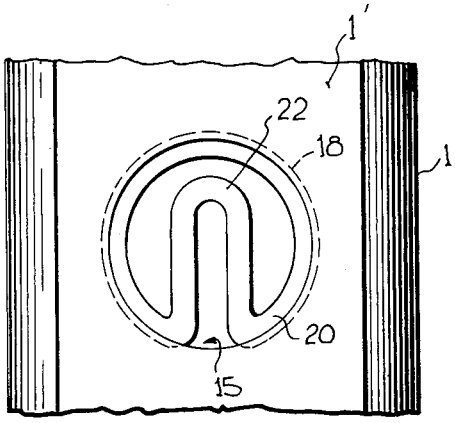
FIG. 10 is a front elevational view, on a greatly enlarged scale, of a portion of the lower tube.

A positive manner of attaining the desired length relationship between the tubes 1 and 3 is shown in FIGS. 7, 8 and 10. This manner resides in blocking all undesired holes 13 or 15 to prevent entry of the detent knob 17, 17', leaving free for entry of the detent knobs 17, 17', only the one hole 13 or 15 of each of tubes 3 and 1 that will give the proper preselected length relationship of tubes 1, 3 and 5.

The above hole blocking means is best illustrated in FIGS. 8 and 10 for telescoping tubes 1 and 3. It will be appreciated that a similar principle applies to the tubes 3 and 5.

Referring to FIGS. 7, 8 and 10, the holes 15 are each formed with an arcuate groove 18 extending partially around the hole 15 (see FIG. 10). Received in the groove 18 is a resilient ring 20, or circlip, having a portion of its periphery inwardly turned to form an U-shaped stop 22 blocking most of the central portion of the ring 20. Inserting of the ring into a hole 15 can be carried out by gripping the arms of the U-shaped stop 22 and bringing them toward one another to reduce the diameter of the ring 20 which is then properly positioned over the groove 18. Release of the arms of the stop 22 allows the ring to expand out and lodge itself in the groove 18. As shown in FIG. 10, the groove 18 does not extend the full periphery of the hole 15. The non-grooved portion of this periphery is located in the lower part of the hole 15 to provide a larger bearing surface for the knob 17 and thus prevent this knob from wear.

As can be seen in FIG. 10, the stop 22, after insertions of the ring, extends across the hole 15 and has prevents the knob 17 to enter this hole.

Figure 3:
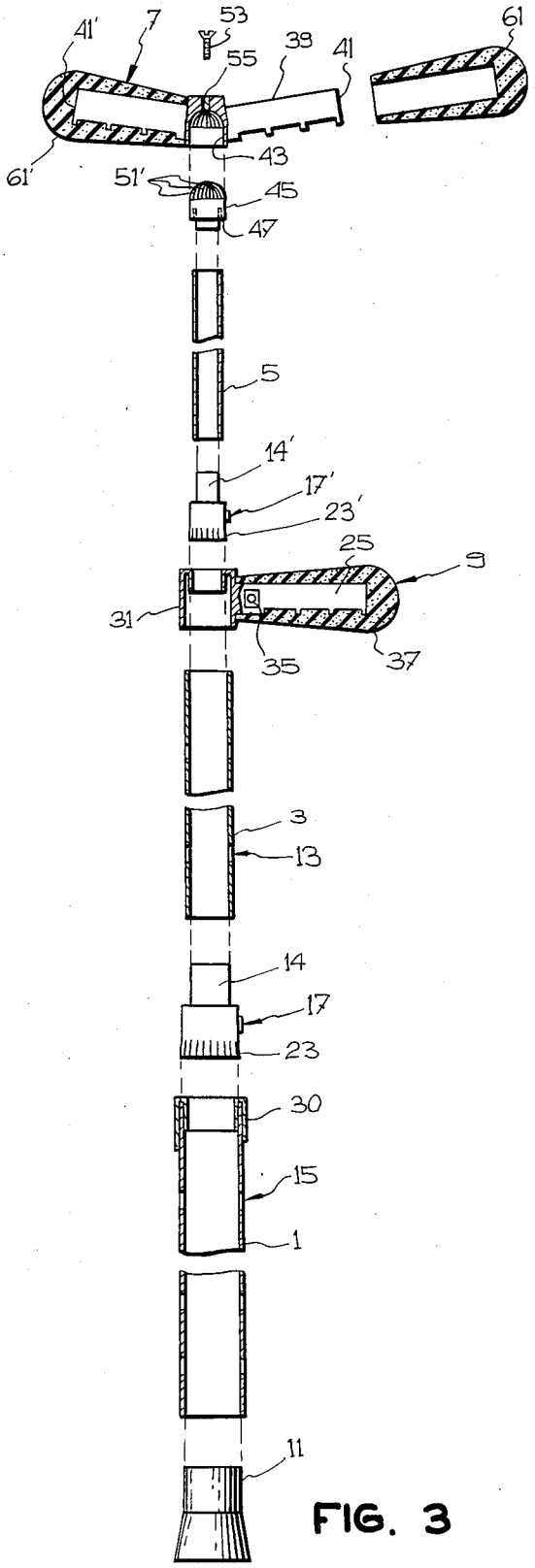
FIG. 3 is an exploded, side elevational view similar to that of FIG. 1, showing most of the parts in longitudinal cross-section.
Figure 11:
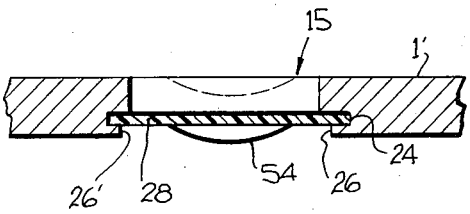
FIG. 11 is a cross-sectional view, on an enlarged scale, through a portion of the lower tube, this view being intended to illustrate a variant of the invention.

Another form of blocking means is shown in FIG. 11. In this case, the holes 15 open inwardly into a slide groove 24 formed fully lengthwise of the flattened section or land 1' of the tube 1 and delimited inwardly by a pair of facing shoulders 26 and 26'. Thus, this straight groove 24 borders the holes 15 of tube 1. A flat strip 20, having essentially the same length as the tube 1, is slid into the inward groove 24 and is stopped downwardly by the top surface of foot pad 11 (FIG. 3). In the case of tube 3 the corresponding strip may be stopped downwardly by the top surface of the plug 14. Alternatively, such a stopping may be achieved by the provision of a small internal projection 54 (FIG. 11) obtained by stamping or embossing the walls of the tubes 1 and/or 3 at appropriate locations. A similar projection may also be provided on top of each tube to prevent the inserted strip 28 from moving up when the crutch is extended. A lateral hole (not shown) may be provided in the tubes 1 and 3 near the top of the strip to allow insertion of a pin for use in disengaging the strip from its groove 24 over the projection 54 in the case this strip has to be changed or readjusted.

Of course, it will be appreciated that this groove 24 and strip 28 construction has also to be present in tube 3.

The strip 28, which may be made of plastic material, is provided with a single hole and with a series of transversal tear lines (not shown) distributed and spaced along its length to make it possible to cut it to one given length where the hole of the strip will register with one preselected hole 15. Once the strip 28 is adjusted in length and positioned in its groove 24, its hole will allow the detent knob 17 to enter only the preselected hole 15. Accordingly, the detent knob 17 will move only into that hole 15 which has thus been freed. Again, the same construction applies as aforesaid to the tube 3 with respect to the detent knob 17' of the tube 5.

As mentioned previously, the upper end of the upper tube 5 is provided with an armpit support 7 which, as shown in FIG. 3, comprises a T-shaped member 39 provided with a pair of free ends 41, 41'. The central portion of the member 39 is provided with downwardly opening cavity 43 extending perpendicularly these to. The cavity 43 is sized and shaped to fit over a plug 45 held in the upper end of the upper tube 5.

As better shown in FIG. 6, the plug 45 has a semi spherical top shaped to fit in the cavity 43, and cylindrical bottom provided with an pseudo-annular groove 47 in which the upper end of the tube 5 may be force-fitted. If desired, the plug 45 may be rigidly connected to the tube 5 by a small tranversal pin 49.

Figure 12:
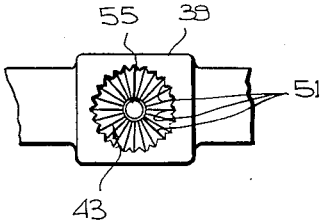
FIG. 12 appearing on the same sheet of drawings as FIGS. 3 and 6, is a partial, bottom view of the central portion of the armpit rest.
Figure 13:
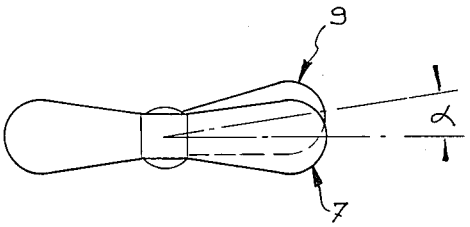
FIG. 13 appearing on the same sheet of drawings as FIGS. 4 and 5, is a top plan view of the combined crutch and walking stick, showing a possible adjustment of the armpit rest with respect to the handle.

The internal surface of the cavity 43 and the top surface of the plug 45 are advantageously provided with a plurality of radial corrugations 51, 51' (see FIGS. 3 and 12) sized to match each other. The corrugations advantageously permit the armpit support to be angularly positioned with respect to the handle 9 (see FIG. 13). They also permit to prevent any undesired rotation of the armpit support away from its preselected angular position after fixation.

Of course, means are provided for detachably fixing the armpit rest 39 onto the plug 45 at the upper end of the upper tube when this plug 45 is fitted in the cavity 43.

These means may consist of a small bolt 53 inserted in a vertical through hole 55 provided in both the central portion of the armpit rest 39 and the plug 45, and screwed in a nut 57 fixed to the bottom of the plug 45. Unscrewing of the bolt 53 permits to release the armpit rest 39 in order to readjust the same angularly. Alternatively, complete unscrewing of the bolt 53 permits to remove the armpit rest 39 if desired, thereby leaving free the upper end of the tube 5 that can then be used as a hook when one is using the invention as a cane exclusively.

As shown in FIG. 3, a pair of round-ended, cushioning sleeves 61, 61' made of flexible material such as rubber, may be force-fitted over the T-shaped member 39 from the free ends 41, 41' thereof toward the central cavity. The sleeves 61, 61' each have a cross-section evenly increasing in size from the central portion of the armpit rest containing cavity 43 to the free ends 41, 41' of the T-shaped member.

To ease in obtaining sliding displacement of the upper tube 5 into the middle tube 3 and sliding displacement of the middle tube 3 in the lower tube 1, suitable guiding means are provided at the upper ends of tubes 3 and 1 and at the bottom ends of tubes 5 and 3, respectively.

As shown in FIGS. 3 and 6 the guiding means at the bottom ends of tubes 3 and 5 consist of small outwardly projecting skirts 23, 23' forming an integral part of the plugs 14, 14' respectably. The skirts 23, 23' extend downwardly from the bottom of the plugs 14, 14' and may be vertically slotted as clearly shown in FIG. 6, to make them more resilient. These skirts which are made of the same plastic material as the plugs 14, 14', keep the bottom ends of the tubes 3 and 5 centrally positioned inside the tubes 1 and 3, respectively, and thus case their respective displacement.

The guiding means on top of the lower tube 1 consist of a small annular sleeve 30 made of plastic material. The sleeve 30 which is held onto the upper end of the tube 1, cooperates with the skirt 23 of the plug 14 to keep the middle tube 3 centrally positioned inside the lower tube 1.

Figure 5:
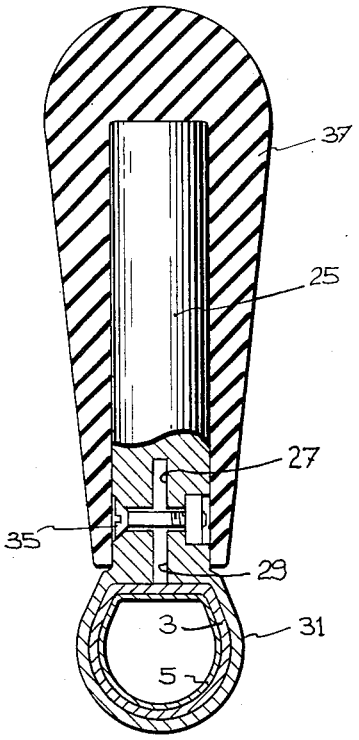
FIG. 5 is a transverse cross-sectional view of the combined crutch and walking stick taken through the handle thereof.
Figure 9:
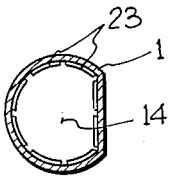
FIG. 9 appearing on the same sheet of drawings as FIGS. 4 and 5 is a tranverse, cross-section view of a tube, showing the bottom of the other tube telescopically mounted therein.

As better shown in FIGS. 3, 5 and 6, a similar, annular sleeve 3' made of plastic material is provided at the upper end of the middle tube 3 for slidably guiding the upper tube 5 centrally inside this middle tube 3. The annular sleeve 3 is slitted in a radial plane at 29 and is integrally extended on both sides of its slit 29 with a radially extending handle tube 25. The handle tube 25 with the walking stick handle 9, is integral to the sleeve 31 and has a slit 27 along a portion of its length in alignment with the slit 29 of the sleeve 31.

Releasable tightening means are provided on the handle tube 25. These means include a screw 35 as shown in FIG. 5, allowing the ends of the slit 27 of the handle tube 25 to close in and, consequently, close in the short slit 29 of the sleeve 31 so that this sleeve 31 is rigidly clamped on top of the middle tube 3. By releasing the pressure of screw 35, it is of course possible to loosen the sleeve 31 to remove the handle 9.

For convenience, the handle 9 is also provided with a cushioning sleeve 37 made of flexible material such as rubber, force fitted over the tube 25 of the handle 9. The sleeve 37 has a cross-section which evenly increases in size from the sleeve 31 to the free end of the tube 25, and has a free end which is preferably hemispherical. It is worth mentioning that the outwardly tapering shape of the sleeve 37 makes it particularly suitable for hanging the combined crutch and walking stick from a table when the handle 9 rests on the flat surface of the table.

I claim:

1. A telescopic combined crutch and walking stick, comprising:

a lower ground-engaging tube:

a middle tube slidably mounted in said ground engaging tube;

first locking means in the middle tube for positioning said middle tube in said lower tube in one of several selectable positions;

an upper tube slidably mounted in said middle tube, said upper tube having a free upper end;

second locking means in the upper tube for positioning said upper tube in said middle tube in one of several selectable positions;

an armpit support mounted at the upper end of said upper tube; and a walking stick handle mounted at the upper end of said middle tube;

wherein said lower, middle and upper tubes are of a length such that, when said tubes are fully retracted one into the other, the length of said combined crutch and stick is about $\frac{1}{3}$ the length thereof when fully extended;

wherein said middle tube and said lower tube are each formed with aligned holes through and spaced along the walls thereof;

wherein said first locking means mounted in the middle tube for positioning said middle tube in said lower tube comprises a first detent knob transversally extending inside of and at the lower end of said middle tube, and spring means for resiliently pressing said first knob into a hole of said aligned holes of said lower tube when in registry therewith;

wherein said second locking means mounted in the upper tube for positioning said upper tube in said middle tube comprises a second detent knob, transversally extending inside of and at the lower end of said upper tube, and spring for means resiliently pressing said second knob into a hole of said aligned holes of said middle tube when in registry therewith; and wherein said combined crutch and walking stick further comprises means for preventing relative rotation of said lower, middle and upper tubes and means for blocking all but one of said aligned holes of said lower tube and all but one of said aligned holes of said middle tube.

2. A combined crutch and walking stick as claimed in claim 1, wherein said rotation preventing means consists of flattened sections provided in said lower, middle and upper tubes, said flattened sections facing one another, and wherein said aligned holes of said lower and middle tubes are respectively formed through the flattened sections of said lower and middle, tubes.

3. A combined crutch and walking stick as claimed in claim 2, wherein said aligned holes of said lower and middle tubes are each formed with a groove along at least part of their walls, and said blocking means comprise resilient rings removably lodged into all of said grooves of said holes but one, for blocking entry of said detent knobs.

4. A combined crutch and walking stick as claimed in claim 2, wherein straight slide grooves are formed lengthwise of and inwardly of said middle and lower tubes flattened sections, said slide grooves bordering the aligned holes of said middle and lower tubes, and wherein said blocking means comprises flat strips slid in said grooves, said strips having essentially the same length as said middle and lower tubes, respectively, and being each provided with a single hole positioned so as to register with a preselected hole of the corresponding middle or lower tube thereby to allow the corresponding detent knob to move only into said preselected hole when the tubes are adjusted with respect to each other.

5. A combined crutch and walking stick as claimed in claim 2, wherein said aligned holes of said middle and lower tubes are evenly spaced from one another.

6. A combined crutch and walking stick as claimed in claim 2, wherein said aligned holes of said middle tube are evenly spaced from one another; said aligned holes of said lower tube are evenly spaced from one another; and said spacing between the aligned holes of one of said middle and lower tubes is greater than the spacing between the aligned holes of the other tube.

7. A combined crutch and walking stick as claimed in claim 2, wherein said first locking means are mounted in a small well provided in a first plug made of plastic material and fixed to the lower end of the middle tube, and wherein said second locking means are mounted in a small well provided in a second plug made of plastic material and fixed to the lower end of the upper tube, said first and second plugs being each provided with an outwardly projecting skirt for slidably guiding the lower ends of said middle and upper tues centrally inside said lower and middle tubes, respectively.

8. A combined crutch and walking stick as claimed in claim 2, wherein said first and second detent knobs each have a rounded outer end surface projecting out of said lower and middle tubes when said knobs are in registery with the holes of said lower and middle tubes and of said middle and upper tubes, respectively.

9. A combined crutch and walking stick as claimed in claim 2, wherein said armpit support comprises a T-shaped member having a transverse armpit rest; a pair of free ends; a central cavity extending perpendicularly into said armpit rest, said cavity being sized to fit over the upper end of the upper tube; and means for detachably fixing said armpit rest onto said upper end of said upper tube when said upper end is fitted in the cavity.

10. A combined crutch and walking stick as claimed in claim 9, including a pair of round-ended, cushioning sleeves made of flexible material force-fitted over said T-shaped member from the free ends thereof toward said central cavity, said sleeves each having a cross-section evenly increasing in size from said central cavity to the free ends of said T-shaped member.

11. A combined crutch and walking stick as claimed in claim 10, wherein said sleeve material is rubber.

12. A combined crutch and walking stick according to claim 10, wherein the upper end of the upper tube is closed by a round shaped plug, and further including a plurality of matching corrugations in the central cavity of the armpit support and in the surface of said round-shaped plug at the upper end of the upper tube to prevent said armpit support from rotating away from a predetermined angular position with respect to the handle.

13. A combined crutch and walking stick as claimed in claim 7 further including:

a first annular sleeve made of plastic material at the upper end of the lower tube for slidably guiding the middle tube centrally inside said lower tube;

a second annular sleeve made of plastic material at the upper end of the middle tube for slidably guiding the upper tube centrally inside said middle tube, said second annular sleeve being slitted in a radial plane and being integrally extended from both sides of its slit with a handle tube, said handle tube forming said walking stick handle and having a slit along a portion of its length in alignement with the slit of the second sleeve; and releasable tightening means on said handle tube to pinch the slit of said handle tube and the slit of said second sleeve in order to rigidly fix said second sleeve around the upper end of said middle tube.

14. A combined crutch and walking stick as claimed in claim 13, further comprising a round-ended cushioning sleeve made of flexible material force-fitted over said handle tube, said sleeve having a cross-section evenly increasing in size from said second sleeve to the free end of said handle tube.

15. A combined crutch and walking stick as claimed in claim 14, wherein said sleeve material is rubber.

16. A combined crutch and walking stick according to claim 9, wherein the upper end of the upper tube is closed by round shaped plug, and further including a plurality of matching corrugations in the central cavity of the armpit support and in the surface of said round-shaped plug at the upper end of the upper tube to prevent said armpit support from rotating away from a predetermined angular position with respect to the handle.

* * * * *